US011248607B2

(12) United States Patent
North

(10) Patent No.: US 11,248,607 B2
(45) Date of Patent: Feb. 15, 2022

(54) MULTI-STAGE VACUUM BOOSTER PUMP ROTOR

(71) Applicant: Edwards Limited, Burgess Hill (GB)

(72) Inventor: Michael Henry North, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 217 days.

(21) Appl. No.: 16/478,342

(22) PCT Filed: Jan. 18, 2018

(86) PCT No.: PCT/GB2018/050147
§ 371 (c)(1),
(2) Date: Jul. 16, 2019

(87) PCT Pub. No.: WO2018/134600
PCT Pub. Date: Jul. 26, 2018

(65) Prior Publication Data

US 2019/0368487 A1 Dec. 5, 2019

(30) Foreign Application Priority Data

Jan. 20, 2017 (GB) ..... 1700995

(51) Int. Cl.
*F04C 18/12* (2006.01)
*F04C 23/00* (2006.01)
(Continued)

(52) U.S. Cl.
CPC ..... *F04C 18/126* (2013.01); *F04C 23/001* (2013.01); *F04C 25/02* (2013.01);
(Continued)

(58) Field of Classification Search
CPC .... F04C 18/126; F04C 23/001; F04C 18/082; F04C 11/001; F01C 21/02
See application file for complete search history.

(56) References Cited

U.S. PATENT DOCUMENTS 2,659,239 A * 11/1953 Hans ..... F01C 21/008 74/395
4,426,162 A * 1/1984 Tsuchiya ..... F16C 3/02 384/280

(Continued)

FOREIGN PATENT DOCUMENTS

CN 201396281 Y 2/2010
CN 201763609 U 3/2011

(Continued)

OTHER PUBLICATIONS

Translation of First Office Action and Search Report dated Jan. 21, 2021 received in TW counterpart application No. 107102122, 3 pp.

(Continued)

*Primary Examiner* — Deming Wan
(74) *Attorney, Agent, or Firm* — Shumaker & Sieffert, P.A.

(57) ABSTRACT

A rotor for a multi-stage vacuum pump, a multi-stage vacuum pump and a method. The rotor comprises: a plurality of rotary vanes, the plurality of rotary vanes being axially displaced and coaxially aligned; a pair of end shafts, each end shaft extending from opposing axial ends of the plurality of rotary vanes; and an inter-vane shaft extending between adjacent rotary vanes of the plurality of rotary vanes, the inter-vane shaft having a diameter which is greater than that of the end shafts. In this way, the inter-vane shaft provided between each rotary vane may have an increased diameter, which improves the stiffness of the shaft and changes the modal frequency of the rotor. Such a change in the modal frequency is typically sufficient to improve its operation.

18 Claims, 4 Drawing Sheets

(51) Int. Cl.

| | |
|---|---|
| ***F04C 18/08*** | (2006.01) |
| ***F04C 11/00*** | (2006.01) |
| *F04C 25/02* | (2006.01) |

(52) U.S. Cl.
CPC ..... *F04C 2220/10* (2013.01); *F04C 2240/20* (2013.01); *F04C 2240/601* (2013.01)

(56) References Cited

U.S. PATENT DOCUMENTS

| | | | | |
|---|---|---|---|---|
| 8,662,869 | B2 * | 3/2014 | Suzuki | F04C 18/126 418/10 |
| 2004/0081565 | A1 | 4/2004 | Kuramoto et al. | |
| 2004/0247465 | A1 | 12/2004 | Yoshimura | |
| 2007/0048162 | A1 | 3/2007 | Imai et al. | |
| 2008/0118383 | A1 * | 5/2008 | Park | F04C 18/126 418/9 |
| 2009/0214368 | A1 | 8/2009 | Schofield et al. | |
| 2009/0285711 | A1 | 11/2009 | Inagaki et al. | |
| 2009/0311113 | A1 * | 12/2009 | Kettlewell | F04C 18/126 417/244 |
| 2013/0192037 | A1 * | 8/2013 | Muilenburg | F16C 33/046 29/402.09 |

FOREIGN PATENT DOCUMENTS

| | | | |
|---|---|---|---|
| CN | 103089647 | A | 3/2012 |
| JP | S6332186 | A | 2/1988 |
| JP | H05118291 | A | 5/1993 |
| JP | H06117385 | A | 4/1994 |
| JP | H08118291 | A | 5/1996 |
| JP | 2007056764 | A | 3/2007 |
| JP | 2011202604 | A | 10/2011 |
| KR | 20120036400 | A | 4/2012 |

OTHER PUBLICATIONS

Combined Search and Examination Report under Sections 17 and 18 (3) dated Jun. 23, 2017 in counterpart GB Application No. 1700995.2, 5 pp.

International Search Report and the Written Opinion of the International Searching Authority dated Mar. 22, 2018 in counterpart International Application No. PCT/GB2018/050147, 14 pp.

Translation of First Office Action and Search Report dated Apr. 24, 2020 received in CN counterpart application No. 201880007720.7, 11 pp.

Translation of the Notification of Reason for Rejection from counterpart Japanese Application No. 2019-538602 dated Oct. 4, 2021, 5 pp.

* cited by examiner

MULTI-STAGE VACUUM BOOSTER PUMP ROTOR

This application is a national stage entry under 35 U.S.C. § 371 of International Application No. PCT/GB2018/050147, filed Jan. 18, 2018, which claims the benefit of GB Application 1700995.2, filed Jan. 20, 2017. The entire contents of International Application No. PCT/GB2018/050147 and GB Application 1700995.2 are incorporated herein by reference.

TECHNICAL FIELD

The present disclosure relates to a rotor for a multi-stage vacuum pump, a multi-stage vacuum pump and a method.

BACKGROUND

Vacuum pumps are known. These pumps are typically employed as a component of a vacuum system to evacuate devices. Also, these pumps are used to evacuate fabrication equipment used in, for example, the production of semiconductors. Rather than performing compression from a vacuum to atmosphere in a single stage using a single pump, it is known to provide multi-stage vacuum pumps where each stage performs a portion of the complete compression range required to transition from a vacuum to atmospheric pressure.

Although such multi-stage vacuum pumps provide advantages, they also have their own shortcomings. Accordingly, it is desired to provide an improved arrangement for multi-stage vacuum pumps.

SUMMARY

According to a first aspect, there is provided a rotor for a multi-stage roots-type vacuum pump, comprising: a plurality of rotary vanes, the plurality of rotary vanes being axially displaced and coaxially aligned; a pair of end shafts, each end shaft extending from opposing axial ends of the plurality of rotary vanes; and an inter-vane shaft extending between adjacent rotary vanes of the plurality of rotary vanes, the inter-vane shaft having a diameter which is greater than that of the end shafts.

The first aspect recognises that when providing a plurality of rotary vanes arranged on a common shaft, the diameter of the shaft extending between adjacent rotary vanes may cause the modal frequency of the rotor to be close enough to the operating frequency of the rotor to cause difficulties. Accordingly, a rotor for a vacuum pump is provided. The rotor may be a roots-type rotor used by a multi-stage vacuum pump. The rotor may have more than one rotary vane. Each of the rotary vanes may share a common axis and may share a common shaft. The vanes may be axially displaced or separated and coaxially or concentrically-aligned. The rotor may be provided with a pair of end shafts. The end shafts may extend or protrude from opposing or distal axial ends of the plurality of rotary vanes. An inter-vane shaft may be provided which extends between or couples adjacent rotary vanes. The inter-vane shaft may be configured with a diameter which is greater than that of the end shafts. In this way, the inter-vane shaft provided between each rotary vane may have an increased diameter, which improves the stiffness of the shaft and changes the modal frequency of the rotor. Such a change in the modal frequency is typically sufficient to improve its operation.

In one embodiment, the rotary vanes have epicycloid portions and a central hypocycloid portion defined by surrounding hypocycloidic faces and the inter-vane shaft has a diameter which exceeds a distance of closest approach of the surrounding hypocycloidic faces. Accordingly, in a roots-type rotor, there are provided epicycloid portions (which define the radial lobes of the rotor) together with a central hypocycloid portion (which defines the radially-inner part of the rotor). The inter-vane shaft may be dimensioned to have a diameter which is greater than that of the central hypocycloid portion, which helps to stiffen the rotor and change the modal frequency of the rotor.

In one embodiment, the rotary vanes have a pair of epicycloid portions and a central hypocycloid portion defined by opposing hypocycloidic faces and the inter-vane shaft has a diameter which exceeds a distance of closest approach of the opposing hypocycloidic faces.

In one embodiment, the inter-vane shaft comprises a collar fitted onto an internal shaft extending between the adjacent rotary vanes. Accordingly, the increase in diameter of the inter-vane shaft may be achieved using a collar which is fitted onto an internal shaft which extends between the adjacent rotary vanes.

In one embodiment, the internal shaft and the adjacent rotary vanes are unitary. Accordingly, the internal shaft and the rotary vanes may be made from a single, unitary member, rather than being made from different, attachable, component parts.

In one embodiment, the collar comprises separable portions. Providing a separable or split collar made of portions that may be disconnected or decoupled makes fitting the collar on to the internal shaft easier.

In one embodiment, the collar comprises a releasably fixable pair of hemi-cylinders. The hemi-cylinders together make a cylinder of the required diameter.

In one embodiment, the wherein the inter-vane shaft comprises members fitted onto an internal shaft extending between the adjacent rotary vanes. Accordingly, the inter-vane shaft itself may be extended by individual members fitted onto the internal shaft.

In one embodiment, the internal shaft is axially faceted to receive the members, the internal shaft and the members cooperating to provide the inter-vane shaft. Accordingly, the shaft may be faceted during fabrication in order to receive the members.

In one embodiment, the internal shaft has a cylindrical portion having a diameter which exceeds a distance of closest approach of the opposing hypocycloidic faces of the vanes, each facet is defined by a planar surface and the members are shaped fit the facets and to continue the cylindrical portion. Having a planar surface makes the fabrication of the members to fit that planar surface much easier.

In one embodiment, the inter-vane shaft comprises inserts fitted onto an indented internal shaft extending between the adjacent rotary vanes. Accordingly, the internal shaft may be indented. Such indentation may occur during fabrication of the rotor. Accordingly, the inserts may be fitted into those indents in order to restore the inter-vane shaft to a cylindrical shape.

In one embodiment, the indented internal shaft defines axially-extending indents shaped to receive complimentary axially-extending inserts, the indented internal shaft and the axially-extending inserts cooperating to provide the inter-vane shaft.

In one embodiment, the indented internal shaft has a cylindrical portion having a diameter which exceeds a distance of closest approach of the surrounding hypocycloidic faces of the vanes, the indents are defined by hypocycloidic surfaces matching the surrounding hypocycloidic faces and the inserts are shaped fit the indents and to continue the cylindrical portion.

In one embodiment, the indented internal shaft defines a pair of axially-extending indents shaped to receive a complimentary pair of axially-extending inserts, the indented internal shaft and the pair of axially-extending inserts cooperating to provide the inter-vane shaft.

In one embodiment, the indented internal shaft has a cylindrical portion having a diameter which exceeds a distance of closest approach of the opposing hypocycloidic faces of the vanes, the indents are defined by a pair of opposing hypocycloidic surfaces matching the opposing hypocycloidic faces and the inserts are shaped fit the indents and to continue the cylindrical portion.

In one embodiment, the inserts comprise a hypocycloidic side which fits the hypocycloidic surfaces and a circular arc side having the diameter.

According to a second aspect, there is provided a multi-stage vacuum pump, comprising: a first stage pump; a second stage pump; and a rotor according to the first aspect extending within both the first stage pump and the second stage pump.

According to a third aspect, there is provided a method, comprising: providing a plurality of rotary vanes of a rotor for a multi-stage roots-type vacuum pump, the plurality of rotary vanes being axially displaced and coaxially aligned; providing a pair of end shafts, each end shaft extending from opposing axial ends of the plurality of rotary vanes; and providing an inter-vane shaft extending between adjacent rotary vanes of the plurality of rotary vanes, the inter-vane shaft having a diameter which is greater than that of the end shafts.

In one embodiment, the rotary vanes have epicycloid portions and a central hypocycloid portion defined by surrounding hypocycloidic faces and the inter-vane shaft has a diameter which exceeds a distance of closest approach of the surrounding hypocycloidic faces.

In one embodiment, the rotary vanes have a pair of epicycloid portions and a central hypocycloid portion defined by opposing hypocycloidic faces and the inter-vane shaft has a diameter which exceeds a distance of closest approach of the opposing hypocycloidic faces.

In one embodiment, the method comprises fitting a collar fitted onto an internal shaft extending between the adjacent rotary vanes to form the inter-vane shaft.

In one embodiment, the internal shaft and the adjacent rotary vanes are unitary.

In one embodiment, the collar comprises separable portions.

In one embodiment, the collar comprises a releasably fixable pair of hemi-cylinders.

In one embodiment, the method comprises fitting members onto an internal shaft extending between the adjacent rotary vanes to form the inter-vane shaft.

In one embodiment, the internal shaft is axially faceted to receive the members, the internal shaft and the members cooperating to provide the inter-vane shaft.

In one embodiment, the internal shaft has a cylindrical portion having a diameter which exceeds a distance of closest approach of the opposing hypocycloidic faces of the vanes, each facet is defined by a planar surface and the members are shaped fit the facets and to continue the cylindrical portion.

In one embodiment, the method comprises fitting inserts onto an indented internal shaft extending between the adjacent rotary vanes to form the inter-vane shaft.

In one embodiment, the indented internal shaft defines axially-extending indents shaped to receive complimentary axially-extending inserts, the indented internal shaft and the axially-extending inserts cooperating to provide the inter-vane shaft.

In one embodiment, the indented internal shaft has a cylindrical portion having a diameter which exceeds a distance of closest approach of the surrounding hypocycloidic faces of the vanes, the indents are defined by hypocycloidic surfaces matching the surrounding hypocycloidic faces and the inserts are shaped fit the indents and to continue the cylindrical portion.

In one embodiment, the indented internal shaft defines a pair of axially-extending indents shaped to receive a complimentary pair of axially-extending inserts, the indented internal shaft and the pair of axially-extending inserts cooperating to provide the inter-vane shaft.

In one embodiment, the indented internal shaft has a cylindrical portion having a diameter which exceeds a distance of closest approach of the opposing hypocycloidic faces of the vanes, the indents are defined by a pair of opposing hypocycloidic surfaces matching the opposing hypocycloidic faces and the inserts are shaped fit the indents and to continue the cylindrical portion.

In one embodiment, the inserts comprise a hypocycloidic side which fits the hypocycloidic surfaces and a circular arc side having the diameter.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present disclosure will now be described further, with reference to the accompanying drawings.

DETAILED DESCRIPTION

Before discussing the embodiments in any more detail, first an overview will be provided. Embodiments provide an arrangement for a multi-stage roots-type vacuum pump. In such a vacuum pump, a rotor is provided with multiple rotary vanes, each sharing a common rotor shaft. Those rotary vanes are typically axially separated along the common shaft by an inter-vane shaft. The inter-vane shaft extending between the different rotary vanes typically undergoes high levels of stress during rotation of the rotor. The bending mode frequency of the rotor can be close to the operating frequency of the rotor, which leads to unacceptable mechanical deflection of the rotor during operation. Accordingly, embodiments provide arrangements which enlarge the diameter of the inter-vane shaft in order to modify the natural frequency of the rotor away from its operating frequency.

In one embodiment, a collar is fixed on to the inter-vane shaft extending between the rotary vanes, whilst in other embodiments shims or inserts are added to the inter-vane shaft, which has been machined to be indented or faceted during manufacture of the rotor, in order to restore that indented or faceted shaft back to its previous cylindrical form.

Two-Stage Pump

Figure 1A:
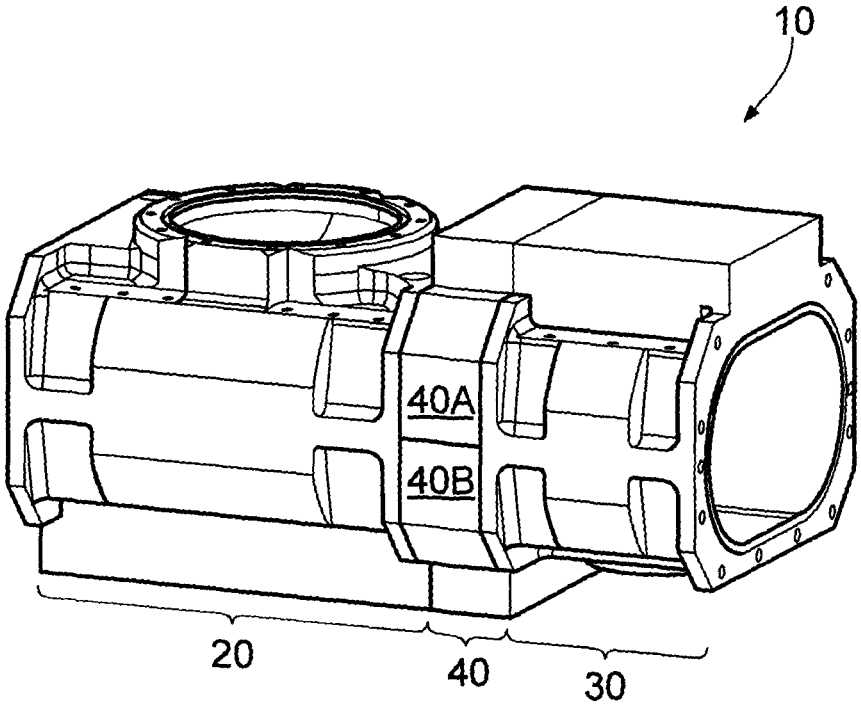
FIGS. 1A and 1B illustrate a two-stage booster pump according to one embodiment.
Figure 1B:
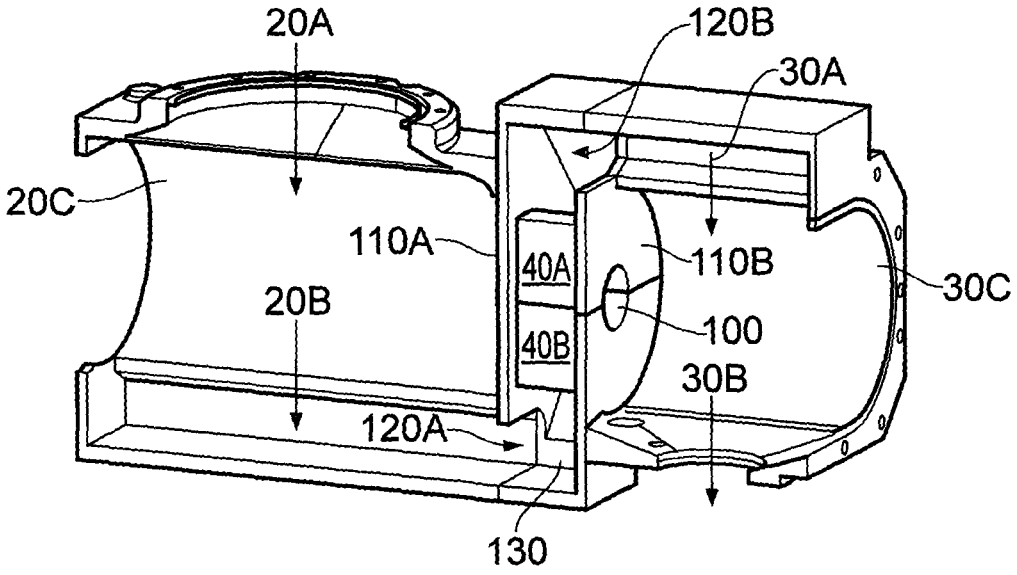

FIGS. 1A and 1B illustrate a two-stage booster pump, generally 10, according to one embodiment. A first pumping stage 20 is coupled with a second pumping stage 30 via an inter-stage coupling unit 40. The first pumping stage 20 has a first stage inlet 20A and a first stage exhaust 20B. The second pumping stage 30 has a second stage inlet 30A and a second stage exhaust 30B.

Coupling

The inter-stage coupling 40 is formed from a first portion 40A and a second portion 40B. The first portion 40A is releasably fixable to the second portion 40B. When brought together, the first and second portions 40A, 40B define a gallery 130 within the interstage coupling unit through which gas may pass during operation of the pump. The inter-stage coupling unit 40 defines a cylindrical void 100 which extends through the width of the inter-stage coupling unit 40. The first portion 40A forms a first portion of the void 100 and the second portion 40B forms a second portion of the void 100. The void 100 separates to receive a one piece rotor 50, as will now be described in more detail.

Rotor

Figure 2:
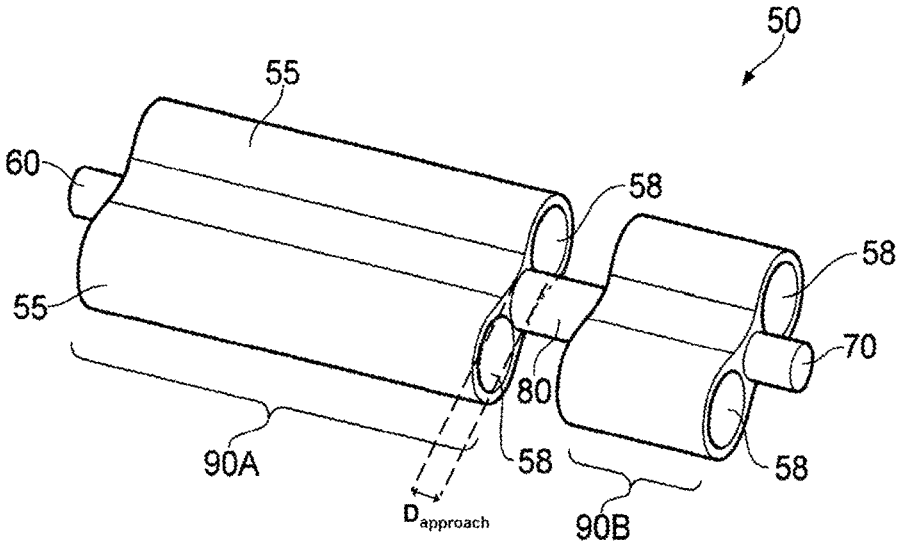
FIG. 2 is a perspective view of a rotor used in the two-stage booster pump of FIGS. 1A and 1B.

FIG. 2 is a perspective view of the rotor 50. The rotor 50 is a rotor of the type used in a positive displacement lobe pump which utilises meshing pairs of lobes. Each rotor has a pair of lobes formed symmetrically about a rotatable shaft. Each lobe 55 is defined by alternating tangential sections of curves. The curves can be of any suitable form such as circular arcs, or hypocycloidal and epicycloidal curves, or a combination of these, as is known. In some examples, the rotary vanes may have epicycloid portions and a central hypocycloid portion defined by surrounding hypocycloidic faces. The distance of closest approach of the surrounding hypocycloidic faces $D_{approach}$ is shown in FIG. 2 as the shortest distance from a surface defining a first hypocycloidic face to a surface defining a second hypocycloidic face. In this example, the rotor 50 is unitary, machined from a single metal element and cylindrical voids 58 extend axially through the lobes 55 to reduce mass.

A first axial end 60 of the shaft is received within a bearing provided by a head plate (not shown) of the first pumping stage 20 and extends from a first rotary vane portion 90A which is received within a stator of the first stage 20. An intermediate axial portion 80 extends from the first rotary vane portion 90A and is received within the void 100. The void 100 provides a close fit on the surface of the intermediate axial portion 80, but does not act as a bearing. A second rotary vane portion 90B extends axially from the intermediate axial portion 80 and is received within a stator of the second stage 30. A second axial end 70 extends axially from the second rotary vane portion 90B. The second axial end 70 is received by a bearing in a head plate (not shown) of the second pumping stage 30. The rotor 50 is machined as a single part, with cutters forming the surface of the pair of lobes 55. The axial portions 60, 70, 80 are being turned to form the first rotary vane portion 90A and the second rotary vane portion 90B.

As will be understood, a second rotor 50 (not shown) is received within a second void 100 which also extends through the width of the inter-stage coupling 40 but is laterally spaced from the first void 100. The second rotor 50 is identical to the aforementioned rotor 50 and is rotationally offset by 90° thereto so that the two rotors 50, mesh in synchronism.

Pump Stage Stators

Returning to FIG. 1A, the first pumping stage pump 20 comprises a unitary stator 22, forming a chamber 24 therewithin. The chamber 24 being sealed at one end by the head plate (not shown) and at the other end by the inter-stage coupling unit 40. The unitary stator 22 has a first inner surface 20C. In this embodiment, the first inner surface 20C is defined by equal semi-circular portions coupled to straight sections which extend tangentially between the semi-circular portions to define a void/chamber 24 which receives the rotors 50. However, embodiments may also define a generally-figure-of-eight cross-section void. The second pumping stage 30 comprises a unitary stator 32 forming chamber 34 therewithin. The chamber 34 being sealed at one end by the head plate (not shown) and at the other end by the inter-stage coupling unit 40. The unitary stator 32 has a second inner surface 30C defining a slightly figure-of-eight cross-sectional chamber 34 which receives the rotors 50. The presence of the unitary stators 22, 32 greatly increases the mechanical integrity and reduces the complexity of the first pumping stage 20 and the second pumping stage 30. In an alternative embodiment, the head plate could also be integrated into each stator unit 22, 32 to form a bucket type arrangement, such an approach would further reduce the number of components present.

The first rotary vane portions 90A of the rotors 50, mesh in operation and follow the first inner surface 20C to compress gas provided from an upstream device or apparatus at a first stage inlet 20A and provide the compressed gas at a first stage exhaust 20B. The compressed gas provided at the first stage exhaust 20B passes through an inlet aperture 120A formed in a first face 110A of the inter-stage coupling unit 40. The first face 110A represents a boundary between the first pumping stage 20 and the gallery 130. The compressed gas travels through a gallery 130 formed within the inter-stage coupling unit 40 and exits through an outlet aperture 120B in a second face 110B of the inter-stage coupling unit 40. The second face 110B represents a boundary between the gallery 130 and the second pumping stage 30. The compressed gas exiting the outlet aperture 120B is received at a second stage inlet 30A. The compressed gas received at the second stage inlet 30A is further compressed by the second rotary vane portions 90B of the rotors 50 as they mesh and follow the second inner surface 30C and the gas exits via a second stage exhaust 30B.

Assembly

The assembly of the two-stage booster pump 10 is typically performed on a turn-over fixture. The unitary stator 22 of the first pumping stage pump 20 is secured to the build fixture. The head plate is attached to the stator 22 and then the assembly rotated through 180 degrees.

The two rotors 50 are lowered into the first stage stator 22. The first portion 40A and the second portion 40B of the inter-stage coupling 40 are slid together over the intermediate axial portion 80 to retain first rotary vane portion 90A within the first pumping stage 20. The first portion 40A and the second portion 40B of the inter-stage coupling unit 40 are then typically dowelled and bolted together. The assembled halves of the inter-stage coupling 40 are then attached to the unitary stator 22 of the first pumping stage 20.

The unitary stator 32 of the second pumping stage 30 is now carefully lowered over the second rotary vane portion 90B and attached to the inter-stage coupling unit 40.

A head plate is now attached to the unitary stator 32 of the second stage pump 30. The two rotors 50 are retained by bearings in the two head plates.

Rotor Modification

The rotor 50 was analysed to understand its natural frequencies. It can be shown that the transitional displacement of the rotor 50 under a 100,000N uniformly-distributed load applied to one side of both the first rotary vane portion 90A and the second rotary vane portion 90B is up to 1.4 mm. As can be appreciated, dependent upon the tolerances and operational frequency of the two-stage booster pump 10, this amount of displacement may lead to damage within the inter-stage coupling 40.

Figure 3:
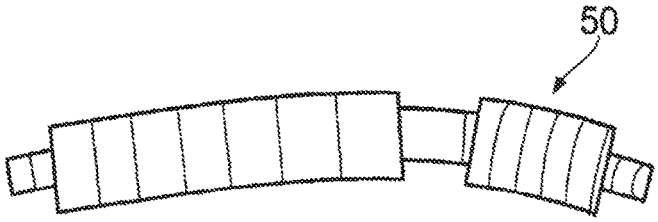
FIG. 3 illustrates the bending modes of the rotor of FIG. 2.

FIG. 3 illustrates the bending modes of the rotor 50. As can be seen, the first bending modes occur at 119 Hz, which are close to the operating frequency of the rotor 50.

Strengthening Collar

Figure 4:
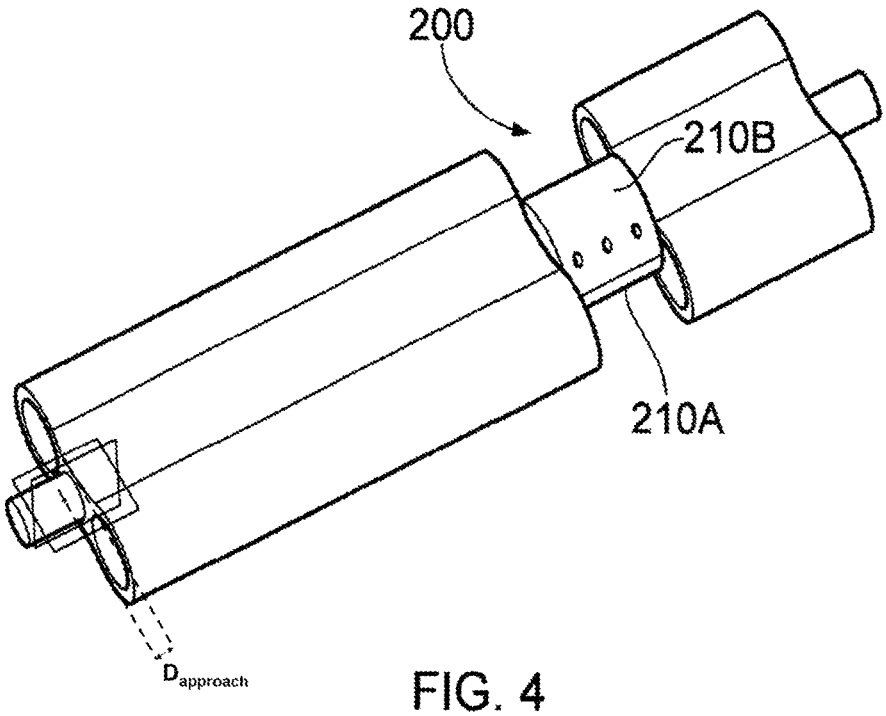
FIG. 4 illustrates the provision of a collar according to one embodiment.
Figure 5:
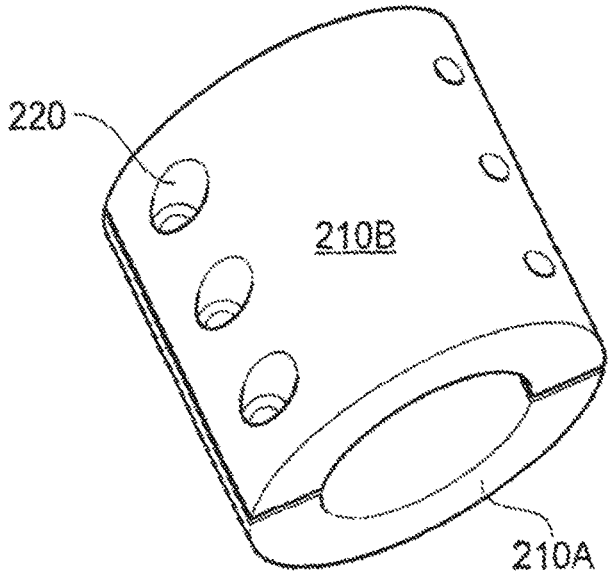
FIG. 5 shows the collar of FIG. 4 in more detail.

FIG. 4 illustrates the provision of a collar, generally 200, according to one embodiment. The collar 200, shown more clearly in FIG. 5, comprises a pair of hemi-cylindrical elements 210A, 210B dimensioned to be received on an outer surface of the intermediate axial portion 80. The pair of hemi-cylindrical elements 210A, 210B together, once fixed onto the intermediate axial portion 80, extend the diameter of the intermediate axial portion 80. In this embodiment, the pair of hemi-cylindrical elements 210A, 210B extend the diameter of the intermediate axial portion 80 to 100 mm. In this embodiment, M8 screws are received by screw apertures 220 in order to mechanically secure the hemi-cylindrical elements 210A, 210B together. However, it will be appreciated that a variety of different techniques may be used to fix the hemi-cylindrical elements 210A, 210B together. Also, it will be appreciated that the collar 200 may be fabricated from parts of differing configuration.

It can be shown that the transitional displacement of the rotor 50 with the collar 200 under a 100,000N uniformly-distributed load applied to one side of both the first rotary vane portion 90A and the second rotary vane portion 90B reduces to 1.02 mm.

Figure 6:
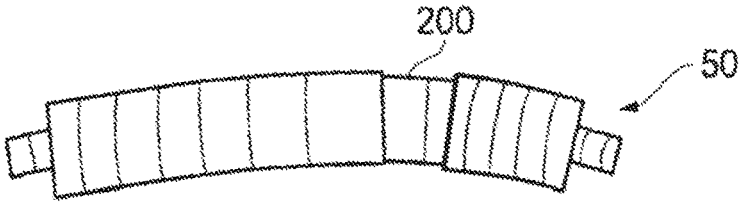
FIG. 6 illustrates the bending modes of the rotor with the collar (as shown in FIG. 4).

As can be seen in FIG. 6, the modal frequency of the rotor 50 with the collar 200 has increased significantly. The first modes are now at 147 Hz. These are significantly further away from the operating frequency of the rotor 50.

Inserts

Figure 7:
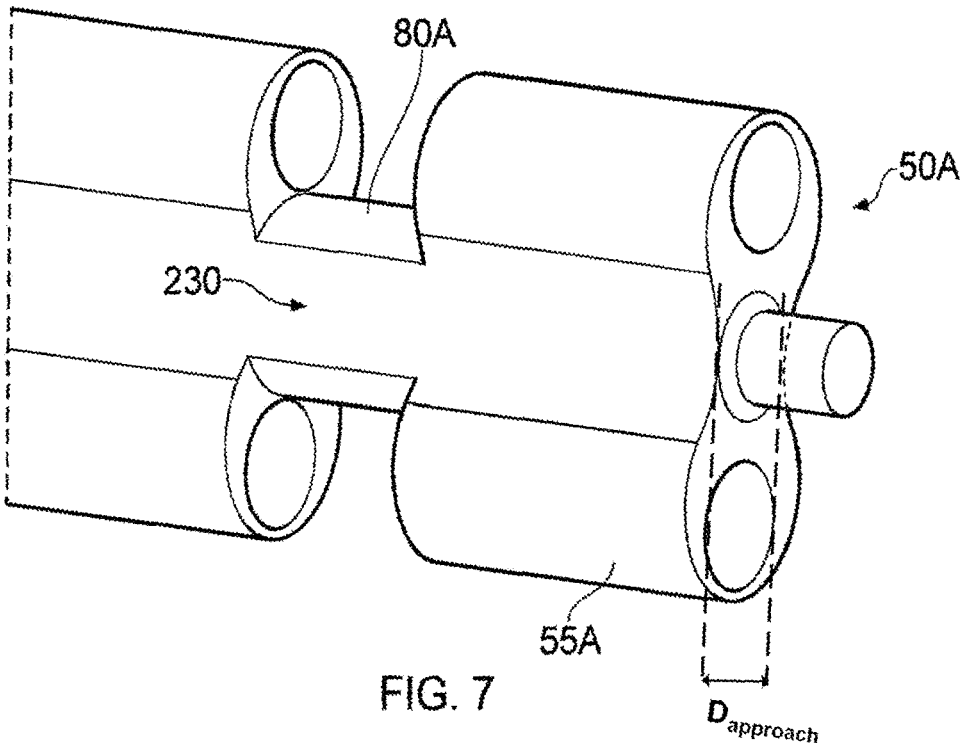
FIG. 7 illustrates a portion of a rotor with an indented face according to one embodiment.

FIG. 7 illustrates a portion of a rotor 50A, according to one embodiment. In this embodiment, the intermediate axial portion 80A is of an enlarged diameter of 100 mm. An indented face 230 is machined into the intermediate axial portion 80A during machining of the lobes 55A. In this embodiment, the diameter of the intermediate axial portion 80A is 100 mm. Inserts (not shown) are then fitted into these indented faces in order to restore the intermediate axial portion 80A to a cylindrical shape of constant diameter of 100 mm. Accordingly, the inserts are axially-elongated with intersecting opposing faces. The cross-section of the inserts is therefore defined by a segment intersecting a hypocycloid. It will be appreciated that the inserts may extend along the length of the intermediate axial portion 80A or at least a pair of inserts may be provided, disposed at either end of the intermediate axial portion 80A in the vicinity of the first face 110A and the second face 110B. The inserts may be initially machined with the hypocycloid inner face which engages with the indented face 230 and is fixed in place. The inserts may then be turned to form the cylindrical outer face.

Shims

Figure 8:
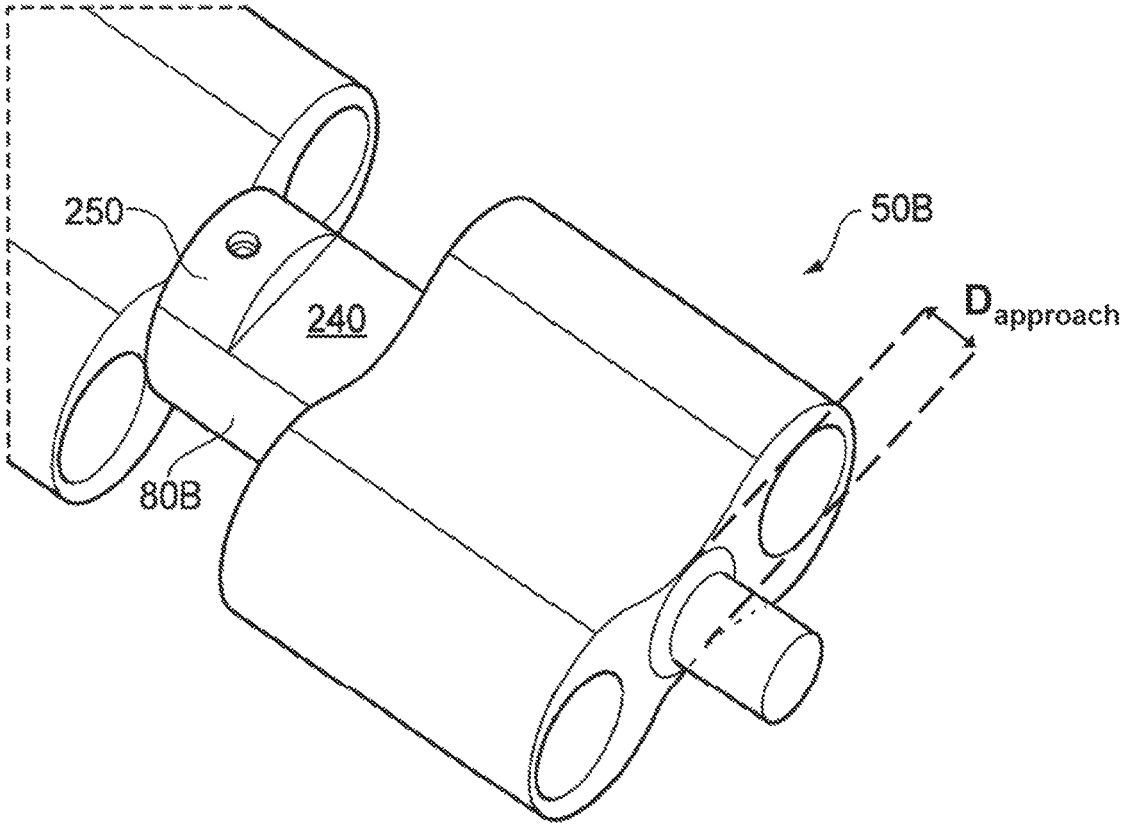
FIG. 8 illustrates a portion of a rotor with a planar face and shim according to one embodiment.

FIG. 8 shows a portion of a rotor 50B, according to one embodiment. In this embodiment, the rotor 50B has an intermediate axial portion 80B which has an enlarged initial diameter of 100 mm. An indented face is initially machined, as mentioned above, but then that face is milled to provide a flat surface 240 onto which cylindrical segments 250 (shims) are fitted in order to restore the intermediate axial portion 80B back to its original cylindrical shape with a constant external diameter. Accordingly, the cylindrical segments 250 are axially-elongate with intersecting opposing faces. The cross-section of the cylindrical segments 250 is therefore defined by a segment intersecting a straight line. It will be appreciated that the cylindrical segments 250 may extend along the length of the intermediate axial portion 80B or at least a pair of cylindrical segments 250 may be provided, disposed at either end of the intermediate axial portion 80B in the vicinity of the first face 110A and the second face 110B. It will be appreciated that manufacturing cylindrical segments is significantly easier than manufacturing the inserts mentioned above. The cylindrical segments 250 may be initially machined with the flat inner face which engages with the flat surface 240 and is fixed in place. The cylindrical segments 250 may then be turned to form the cylindrical outer face.

Figure 9:
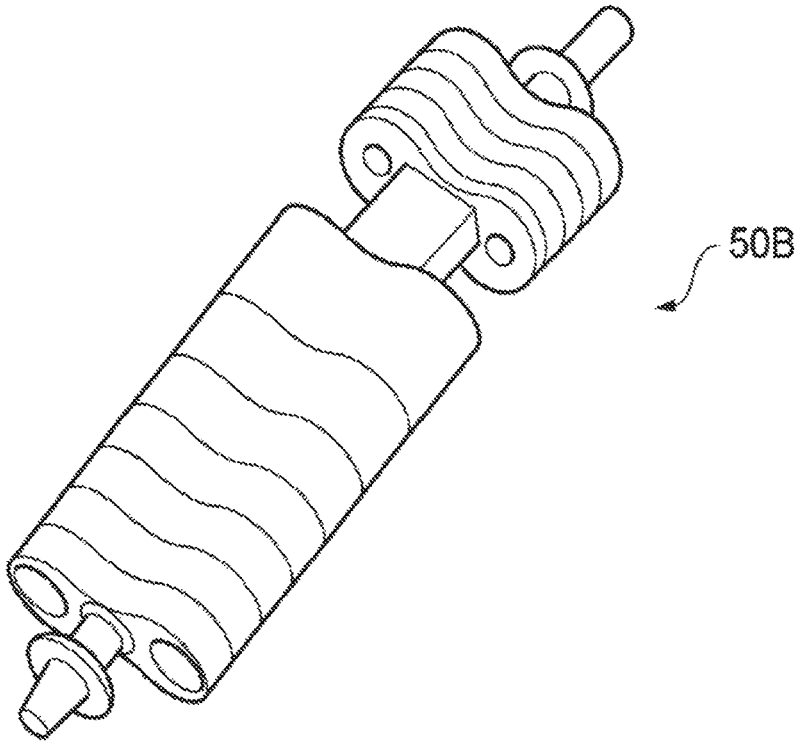
FIG. 9 illustrates the bending modes of the rotor of FIG. 8.

As can be seen in FIG. 9, the modal frequency of the rotor 50B of FIG. 8 having a larger diameter formed with flats is increased significantly over shaft 50 case illustrated in FIG. 3. The first mode is now 180 Hz. This are significantly further away from the operating frequency of the rotor 50.

Embodiments provide two-stage booster rotor stiffening collar, inserts and/or shims. The mechanical strength of a one-piece rotor is increased by the addition of a rotor stiffening collar and/or faces onto which the inserts or shims fit. In one embodiment, the one piece rotor design is for a 6000/2000 m3 booster.

As mentioned above, manufacturing a rotor by a slab-milling process uses large-diameter milling cutters. To cut the full profile, the cutter has to transverse the profile until the centre-line of the cutter has passed the end of the rotor profile. The cutter would therefore gouge into the inter-stage shaft diameter if the shaft diameter is larger than the root width. If the inter-stage shaft diameter was increased to a diameter larger than the root width of the rotor profile, then a mill turning process would be required to machine the rotor profile. This is time-consuming and requires an expensive mill turn machine. The rotor stiffening collar, inserts and/or shims enable slab-milling of the rotor profile and may be attached to the rotor shaft after grinding the shaft diameters. Rotor balancing may be done after the attachment of the stiffening collar.

Embodiments maintain the easy manufacture and strength of a one-piece rotor but add a stiffening collar, inserts and/or shims to raise the natural frequency of the rotor. This can be used in multistage pumps particularly roots designs. This arrangement avoids the need to increase the root diameter of the rotor. Assuming the shaft centre distance and rotational speed is maintained, then the tip diameter must be reduced and this reduces the swept volume. To overcome this the shaft centre distance would need to be increased to enable a larger root and tip diameter to give the same displacement.

Although illustrative embodiments of the disclosure have been disclosed in detail herein, with reference to the accompanying drawings, it is understood that the disclosure is not limited to the precise embodiment and that various changes and modifications can be effected therein by one skilled in the art without departing from the scope of the disclosure as defined by the appended claims and their equivalents.

| REFERENCE SIGNS | |
|---|---|
| two-stage booster pump | 10; 10' |
| first stage pump | 20; 20' |
| first stage inlet | 20A; 20A' |
| first stage exhaust | 20B |
| first inner surface | 20C; 20C' |
| second stage pump | 30; 30' |
| second stage inlet | 30A |
| second stage exhaust | 30B; 30B' |
| second inner surface | 30C |
| inter-stage coupling | 40; 40C |
| first portion | 40A; 40A' |
| second portion | 40B; 40B' |
| rotor | 50; 50A; 50B |
| first axial end | 60 |
| second axial end | 70 |
| intermediate axial portion | 80; 80A |
| first rotary vane portion | 90A |
| second rotary vane portion | 90B |
| void | 100; 100' |
| first face | 110A; 110C; 110E |
| second face | 110B; 110D; 110F |
| inlet aperture | 120A; 120A'; 120C |
| outlet aperture | 120B; 120B'; 120D; 120E |
| gallery | 130; 130' |
| transfer conduit | 140; 140' |
| recirculation inlet aperture | 150 |
| recirculation outlet aperture | 160A; 160B |
| recirculation conduit | 170A |
| shared conduit | 175 |
| valve | 180A; 180B |
| shared inlet | 185 |
| spring | 190A; 190B |
| collar | 200; 200A |
| hemi-cylindrical elements | 210A, 210B |
| screw apertures | 220 |
| indented face | 230 |
| surface | 240 |
| cylindrical segments | 250 |

The invention claimed is:

1. A rotor for a multi-stage roots-type vacuum pump, the rotor comprising:

a plurality of rotary vanes, the plurality of rotary vanes being axially displaced and coaxially aligned;

a pair of end shafts, each end shaft extending from opposing axial ends of the plurality of rotary vanes; and an inter-vane shaft extending between adjacent rotary vanes of the plurality of rotary vanes, the inter-vane shaft having a diameter which is greater than that of the end shafts;

wherein the inter-vane shaft comprises a collar fitted onto an internal shaft extending between the adjacent rotary vanes, the collar comprises separable portions, and the internal shaft and the adjacent rotary vanes are unitary.

2. The rotor of claim 1, wherein the plurality of rotary vanes have epicycloid portions and a central hypocycloid portion defined by surrounding hypocycloidic faces and the inter-vane shaft has a diameter which exceeds a distance of closest approach of the surrounding hypocycloidic faces.

3. The rotor of claim 1, wherein the plurality of rotary vanes have a pair of epicycloid portions and a central hypocycloid portion defined by opposing hypocycloidic faces and the inter-vane shaft has the diameter which exceeds a distance of closest approach of the opposing hypocycloidic faces.

4. The rotor of claim 1, wherein the collar comprises a releasably fixable pair of hemi-cylinders.

5. The rotor of claim 4, wherein the hemi-cylinders comprises screw apertures and are releasable fixed by screws received by the screw apertures.

6. The rotor of claim 1, wherein the inter-vane shaft comprises shims fitted onto an internal shaft extending between the adjacent rotary vanes.

7. The rotor of claim 6, wherein the internal shaft is axially faceted to receive the shims, the internal shaft and the shims cooperating to define the inter-vane shaft.

8. The rotor of claim 7, wherein the plurality of rotary vanes have a pair of epicycloid portions and a central hypocycloid portion defined by opposing hypocycloidic faces, wherein the inter-vane shaft has the diameter which exceeds a distance of closest approach of the opposing hypocycloidic faces, wherein the internal shaft has a cylindrical portion having a diameter which exceeds the distance of closest approach of the opposing hypocycloidic faces of the rotary vanes, and wherein each facet is defined by a planar surface and the shims are shaped fit said facets and to continue the cylindrical portion.

9. The rotor of claim 1, wherein the inter-vane shaft comprises inserts fitted onto an indented internal shaft extending between the adjacent rotary vanes.

10. The rotor of claim 9, wherein the indented internal shaft defines axially-extending indents shaped to receive complimentary axially-extending inserts, the indented internal shaft and the axially-extending inserts cooperating to define the inter-vane shaft.

11. The rotor of claim 9, wherein the plurality of rotary vanes have epicycloid portions and a central hypocycloid portion defined by surrounding hypocycloidic faces, wherein the inter-vane shaft has the diameter which exceeds a distance of closest approach of the surrounding hypocycloidic faces, wherein the indented internal shaft has a cylindrical portion having a diameter which exceeds the distance of closest approach of the surrounding hypocycloidic faces of the rotary vanes, wherein the indents are defined by hypocycloidic surfaces matching the surrounding hypocycloidic faces, and wherein the inserts are shaped fit the indents and to continue the cylindrical portion.

12. The rotor of claim 9, wherein the indented internal shaft defines a pair of axially-extending indents shaped to receive a complimentary pair of axially-extending inserts, the indented internal shaft and the pair of axially-extending inserts cooperating to define the inter-vane shaft.

13. The rotor of claim 9, wherein the plurality of rotary vanes have a pair of epicycloid portions and a central hypocycloid portion defined by opposing hypocycloidic faces, wherein the inter-vane shaft has the diameter which exceeds a distance of closest approach of the opposing hypocycloidic faces, wherein the indented internal shaft has a cylindrical portion having a diameter which exceeds the distance of closest approach of the opposing hypocycloidic faces of the rotary vanes, wherein the indents are defined by a pair of opposing hypocycloidic surfaces matching the opposing hypocycloidic faces, and wherein the inserts are shaped fit the indents and to continue the cylindrical portion.

14. The rotor of claim 13, wherein the inserts comprise a hypocycloidic side which fits the hypocycloidic surfaces and a circular arc side having the diameter.

15. The rotor of claim 1, wherein the separable portions of the collar are releasably fixable to each other.

16. The rotor of claim 15, wherein the separable portions of the collar comprise screw apertures and are releasably fixed to each other by screws received by the screw apertures.

17. A multi-stage vacuum pump, comprising:

a first stage pump;

a second stage pump; and a rotor extending within both the first stage pump and the second stage pump, wherein the rotor comprises:

a plurality of rotary vanes, the plurality of rotary vanes being axially displaced and coaxially aligned;

a pair of end shafts, each end shaft extending from opposing axial ends of the plurality of rotary vanes; and an inter-vane shaft extending between adjacent rotary vanes of the plurality of rotary vanes, the inter-vane shaft having a diameter which is greater than that of the end shafts:

wherein the inter-vane shaft comprises a collar fitted onto an internal shaft extending between the adjacent rotary vanes, the collar comprises separable portions, and the internal shaft and the adjacent rotary vanes are unitary.

18. A method for providing a multi-stage roots-type vacuum pump, comprising:

providing a plurality of rotary vanes of a rotor for the multi-stage roots-type vacuum pump, the plurality of rotary vanes being axially displaced and coaxially aligned;

providing a pair of end shafts, each end shaft extending from opposing axial ends of the plurality of rotary vanes; and providing an inter-vane shaft extending between adjacent rotary vanes of the plurality of rotary vanes, the inter-vane shaft having a diameter which is greater than that of the end shafts, wherein the inter-vane shaft comprises a collar fitted onto an internal shaft extending between the adjacent rotary vanes, the collar comprises separable portions, and the internal shaft and the adjacent rotary vanes are unitary.

* * * * *